US008033760B2

(12) United States Patent
Hinton et al.

(10) Patent No.: US 8,033,760 B2
(45) Date of Patent: Oct. 11, 2011

(54) TENSION ASSEMBLY

(75) Inventors: Harold Gregory Hinton, Sarina (AU); Jeremy Ross Arnot, Mt Hunter (AU); Peter Harold Craig, Cooyal (AU); Timothy Joseph Gaudry, Picton (AU)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 12/424,974

(22) Filed: Apr. 16, 2009

(65) Prior Publication Data

US 2009/0317197 A1 Dec. 24, 2009

(30) Foreign Application Priority Data

Apr. 17, 2008 (AU) ..... 2008901923
Mar. 26, 2009 (AU) ..... 2009901318

(51) Int. Cl.
*E21D 20/00* (2006.01)
*E21D 21/00* (2006.01)

(52) U.S. Cl. ..... 405/302.2; 405/302.1; 405/259.6; 405/259.1

(58) Field of Classification Search ..... 405/302.2, 405/302.1, 259.1, 259.4, 259.5, 259.6
See application file for complete search history.

(56) References Cited

U.S. PATENT DOCUMENTS

| | | | | |
|---|---|---|---|---|
| 5,253,960 | A * | 10/1993 | Scott | 405/302.2 |
| 5,525,013 | A * | 6/1996 | Seegmiller et al. | 405/302.2 |
| 5,931,064 | A * | 8/1999 | Gillespie | 405/259.1 |
| 6,402,433 | B1 * | 6/2002 | Gillespie | 405/302.2 |
| 6,527,482 | B1 * | 3/2003 | Stankus | 405/259.5 |
| 6,612,783 | B2 * | 9/2003 | Stankus et al. | 405/302.2 |
| 6,684,585 | B2 * | 2/2004 | Campbell | 405/302.2 |
| 7,588,394 | B1 * | 9/2009 | Walker et al. | 405/302.2 |
| 7,625,155 | B1 * | 12/2009 | McKinney et al. | 405/302.2 |
| 2002/0110426 | A1 * | 8/2002 | Stankus et al. | 405/259.5 |

* cited by examiner

*Primary Examiner* — Frederic L Lagman
(74) *Attorney, Agent, or Firm* — The Webb Law Firm

(57) ABSTRACT

A tensioning assembly 10 for a cable bolt 11 comprises a clamping device (14, 16) adapted for fastening to the bolt and an outer member 18 adapted for interacting with the clamping device. The outer member 18 is able to undergo relative movement to the clamping device in the direction of the bolt's axis, and under such movement, the clamping device is caused to fasten to the bolt. Furthermore, the outer member is adapted for interacting with the bolt 11 whereby, during such relative movement, twisting of the bolt 11 with respect to the outer member 18 is restrained.

20 Claims, 8 Drawing Sheets

TENSION ASSEMBLY

TECHNICAL FIELD

A tension assembly is disclosed for cable bolts that are suitable for use in mining and tunnelling to provide rock and wall support. The assembly is suitable for use in hard rock applications as well as in softer strata, such as that often found in coal mines. Thus, the term "rock" as used in the specification is to be given a broad meaning to cover all such applications.

BACKGROUND ART

Roof and wall support is vital in mining and tunnelling operations. Mine and tunnel walls and roofs consist of rock strata, which must be reinforced to reduce the possibility of collapse. Rock bolts, such as rigid shaft rock bolts and flexible cable bolts, are widely used for consolidating the rock strata.

In strata support systems, a bore is drilled into the rock by a drill rod, which is removed and a rock bolt is then installed in the drilled hole and secured in place, either mechanically or by using a resin or cement based grout. The rock bolt is tensioned which allows consolidation of the adjacent strata by placing that strata in compression.

To allow the rock bolt to be tensioned, an inserted end of the bolt may be anchored mechanically to the rock formation by engagement of an expansion assembly on the end of bolt with the rock formation. Alternatively, the bolt maybe adhesively bonded to the rock formation with a resin bonding material inserted into the bore hole. Alternatively, a combination of mechanical anchoring and resin bonding can be employed by using both an expansion assembly and resin bonding material.

When resin bonding material is used, it penetrates the surrounding rock formation to adhesively unite the rock strata and to hold firmly the rock bolt within the bore hole. Resin is typically inserted into the bore hole in the form of a two component plastic cartridge having one component containing a curable resin composition and another component containing a curing agent (catalyst). The two component resin cartridge is inserted into the blind end of the bore hole and the mine rock bolt is then inserted into the bore hole such that the end of the mine rock bolt ruptures the two component resin cartridge. With rotation of the mine rock bolt about its longitudinal axis, the compartments within the resin cartridge are shredded and the components are mixed. The resin mixture fills the annular area between the bore hole wall and the shaft of the mine rock bolt. The mixed resin cures and binds the mine rock bolt to the surrounding rock.

Tension assemblies have been proposed to provide tension along cable bolts, for example, which in turn provides a compressive force on the substrate surrounding the anchored bolt, usually a mine shaft roof substrate. Such tension assemblies often involve hydraulic means for installation and require the installer to lift the means above chest height to be placed on the cable end exposed from the bore hole. This can lead to safety issues, depending on the mine shaft roof height.

In one such assembly, with the resin cured about the cable portion in the bore hole, a nut is placed onto a thread cut into a portion of the outer wires of the cable bolt remaining outside the bore hole. The nut is then rotated on the cable bolt toward and to abut the substrate about the bore hole either directly or through a bearer plate disposed on the shaft between the substrate and the nut. Rotation of the nut is continued for a predetermined number of turns to provide tension along the cable. This method has been found to be unreliable in practice, with failures occurring between the nut and cable.

In another assembly, a threaded rod is coupled onto a distal end of the cable using an external coupling. The coupling is disposed within the bore and the threaded rod is arranged to project from the bore. A plate is then disposed on the rod and a nut threadably engaged with the rod to capture the plate. The nut is rotated on the rod such that the plate is forced onto the substrate about the bore hole. This assembly requires a portion of the bore hole, adjacent the bore hole opening, to be widened to accommodate the external coupling. This is disadvantageous in that it requires two drilling events when forming the bore hole. Alternatively, if the bore hole is drilled to have one diameter large enough to accommodate the fitting, a larger space is created between the bore hole wall and the cable bolt, requiring more resin to fix the cable bolt in the bore. This has been shown to reduce bond strength between the cable, resin and bore hole wall.

In a further assembly, a clamping device is mounted onto a distal end of the cable bolt outside the bore. An outer barrel is then located over to engage with the clamping device, whereby the barrel can be moved axially with respect to the cable bolt along the clamping device. This movement can cause a plate that is disposed on the rod to be forced by the outer barrel onto the substrate about the bore hole.

Such known assemblies do not, however, prevent the cable bolt from twisting during tensioning. After a time, the cable bolt can twist back whereby bolt tension is progressively lost.

A reference herein to prior art is not an admission that the prior art forms part of the common general knowledge of a person of ordinary skill in the art in Australia or elsewhere.

SUMMARY OF THE DISCLOSURE

According to a first aspect there is provided a tensioning assembly for a cable bolt, the assembly comprising:

a clamping device adapted for fastening to the bolt; and an outer member adapted for interacting with the clamping device whereby, during relative movement of the clamping device away from the outer member in the direction of the bolt's axis, the clamping device is caused to fasten to the bolt, with the outer member being further adapted for interacting with the bolt whereby, during such relative movement, twisting of the bolt with respect to the outer member is restrained.

When the clamping device is caused to fasten to the bolt it can allow the assembly to apply tension thereto. When rotation of the outer member is restrained or prevented such tensioning can occur with minimal or no bolt twisting with respect to the rock strata. Thus, the cable bolt can better retain tension therewithin over time, thereby providing for more secure rock strata support over time. Further, in contrast to prior tensioning assemblies, cable bolt tensioning can occur without inducing or requiring bolt rotation.

In one form an internal surface portion of the outer member can be adapted for engaging the strands of the bolt to restrain bolt twisting. For example, the internal surface portion can comprise one or more inwardly projecting elongate protrusions (e.g. elongate teeth or ridges) that are each positioned and shaped to protrude into a respective groove defined between adjacent bolt strands, to more effectively fasten and prevent twisting of the bolt thereat.

In one form the outer member can be provided in a barrel-like configuration and be substantially closed at one end save for a passage at that end for the cable bolt. The internal surface portion can be defined at the interior of a hollow insert that is positionable for fastening in a recess defined in the one end to surround the passage. In one form, the insert can be readily/easily fastened onto the cable bolt at a suitable location prior to locating the outer member thereon. Use of such an insert may also enable the one or more elongate protrusions to more readily/easily be formed at the insert interior than would be the case for the outer member. Further, if the assembly were to be reused, such an insert could be discarded and replaced.

The outer member can be further adapted for interacting with rock strata into which the cable bolt is to be anchored in use whereby, as a result of such interaction, rotation of the outer member is restrained, so that cable bolt tensioning can occur with minimal or no twisting/rotation. Whilst an end of the outer member could be adapted for directly abutting rock strata, the assembly can further comprise a plate-like member (e.g. a bearing/bearer plate) which is employed to face and urge against the rock strata in use. The plate-like member can be positioned with respect to the cable bolt (e.g. slid along the bolt via an aperture therethrough) such that, during bolt tensioning, an end of the outer member can be brought into abutment with the plate-like member to urge it against the rock strata in use. This abutment can provide sufficient frictional resistance to thus restrain outer member rotation. At the same time, the plate-like member can retain and support the adjacent rock strata. In another form a key projection and slot arrangement is provided between the outer member and the plate-like member to restrain outer member rotation.

In one form the assembly can further comprise a carrier member that includes a hollow shank for receipt of the cable bolt therethrough, with the shank being externally threaded for engagement with a corresponding internal thread defined at an interior surface of the outer member. The relative movement of the outer member away from the clamping device may, in this case, arise from the carrier member being unscrewed from the outer member.

In one form the clamping device can comprise a barrel and wedge assembly that interact with each other to enable clamping of the assembly to the cable bolt. In this regard the barrel can be located for rotation in a recess of the carrier member that extends into the hollow of the shank, whereby the carrier member is thus still free to rotate, relative to the clamping device, after clamping of the assembly to the cable bolt. To provide for easier rotation of the carrier member with respect to barrel and wedge assembly during the application of tension to the cable bolt, an anti-friction washer or a thrust bearing can be located between the barrel and the shoulder.

The wedges can be positioned in the barrel so that the barrel surrounds the wedges in the recess whereby, during the relative movement (e.g. by unscrewing of the carrier member from the outer member), the barrel is urged against the wedges to force them against the cable bolt, thereby fastening the clamping device (and thus the assembly) to the bolt.

In an embodiment of this form the barrel can comprise a tapered inner surface and each of the wedges can comprise a corresponding and oppositely tapered outer surface. During the relative movement the barrel tapered inner surface can be urged against each wedge's oppositely tapered outer surface. This urging can occur by the action of a shoulder on the wedge, the shoulder being defined at an interior end of the carrier member recess.

Also, during the relative movement (when, for example, unscrewing the carrier member from the outer member) the carrier member can have a head that is defined at an end of the carrier member shank and that extends beyond the outer member in use of the assembly. Such a head can be shaped for engagement by a drive apparatus (e.g. a dolly spanner connected to the drive of a drill rig) to cause the carrier member to move away (e.g. unscrew) from the outer member. For example, the head can be provided with a hexagonal profile.

According to a second aspect there is provided a tensioning assembly for a cable bolt, the assembly comprising:

a clamping device adapted for fastening to the bolt;

a carrier member for the clamping device; and an outer member adapted for location on the carrier member whereby an end of the carrier member projects beyond the outer member, with the end being adapted for engagement by a drive apparatus to cause a relative movement of the carrier member away from the outer member in the direction of the bolt's axis, which movement causes the clamping device to fasten to the bolt.

Such an assembly can allow tension to be provided to the bolt via the carrier member. When, for example, the clamping device is rotatable within the carrier member, such an assembly can allow for bolt tensioning and clamping without requiring or imparting bolt twisting or rotation.

In addition, in the assembly of the second aspect, the outer member can be further adapted for interacting with the cable bolt whereby, during such relative movement, twisting of the bolt with respect to the outer member is restrained.

In this regard, the outer member may have a configuration as defined in the first aspect. In addition, the carrier member and clamping device may also have a configuration as defined in the first aspect.

According to a third aspect there is provided a method for tensioning a cable bolt at a rock substrate, the method comprising the steps of:

anchoring the cable bolt within a bore formed in the rock substrate;

positioning a tensioning assembly on a portion of the cable bolt that extends beyond the bore;

tensioning the cable bolt using the tensioning assembly whilst restraining twisting of the cable bolt.

A cable bolt tensioned according to this method can better retain tension therewithin over time, thereby providing for more secure rock strata support over time.

In the method of the third aspect the step of positioning part or all of the tensioning assembly on the cable bolt can occur prior to the step of anchoring the cable bolt within the bore.

In the method of the third aspect, in the step of restraining twisting of the cable bolt, the twisting can be restrained with respect to the rock strata.

In the method of the third aspect the anchoring step can comprise inserting a fixative container into the bore, then inserting the cable bolt into the bore to cause the cable bolt to fracture the container and release a fixative substance from within the container into the space in the bore surrounding the cable bolt. The anchoring step can further comprise allowing the fixative substance to cure prior to tensioning the cable bolt.

The method of the third aspect may employ the tensioning assembly as defined in the first and second aspects.

BRIEF DESCRIPTION OF THE DRAWINGS

Notwithstanding any other forms which may fall within the scope of the tension assembly and method as set forth in the Summary, a number of specific embodiments of the tension assembly will now be described, by way of example only, with reference to the accompanying drawings in which.

DETAILED DESCRIPTION OF SPECIFIC EMBODIMENTS

Figure 1A:
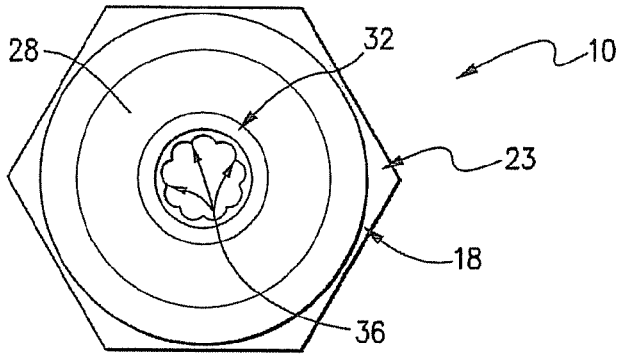
FIGS. 1A to 1C respectively show plan, part-sectional side, and part-sectional underside plan (taken on the line AA of FIG. 1B) views of a cable bolt tensioning assembly in accordance with a first embodiment.

Referring to the Figures, a tensioning assembly 10 is shown for use with a cable bolt 11 (FIGS. 3 and 4) for supporting walls and/or roofs of mining shafts and the like. The assembly 10 is configured for use with cable bolts which typically comprise several cabled steel wire strands 12 wound together to form a cable bolt that has a degree of flexibility, however the bolt may be made from other suitable materials, depending on its application. For example, the bolt may be manufactured from other hard or hardened metals or polymeric materials. The bolt is typically 15-28 mm in diameter, although the cable diameter used may vary with the material used to form the bolt or the type of substrate in which the bolt is to be located. The length of the bolt is typically in the range of about 4 m to 10 m, depending on the application and user requirements.

The tensioning assembly 10 comprises a clamping device in the form of an internally tapered hollow barrel 14 and a corresponding, opposing externally tapered hollow wedges 16 configured to mount to the cable bolt 11. The respective angles of tapering are about 7° with respect to the cable bolt longitudinal axis.

Figure 4:
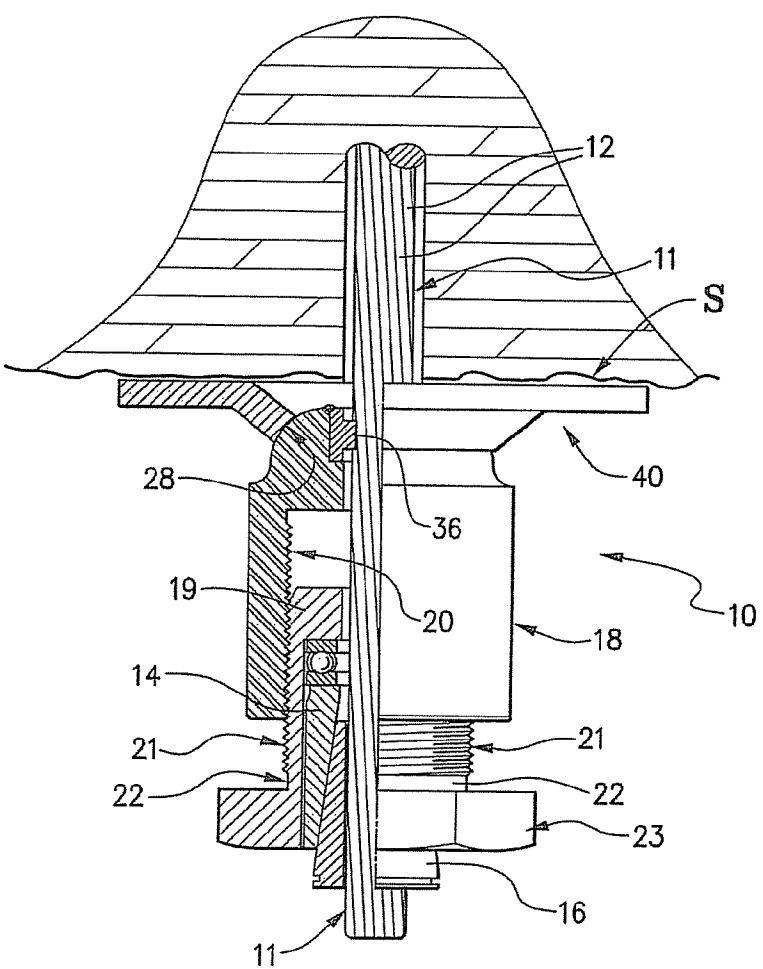
FIG. 4 shows a part-sectional side view of the cable bolt tensioning assembly of FIG. 2 in use with a cable bolt in a second tensioned configuration.
Figure 3:
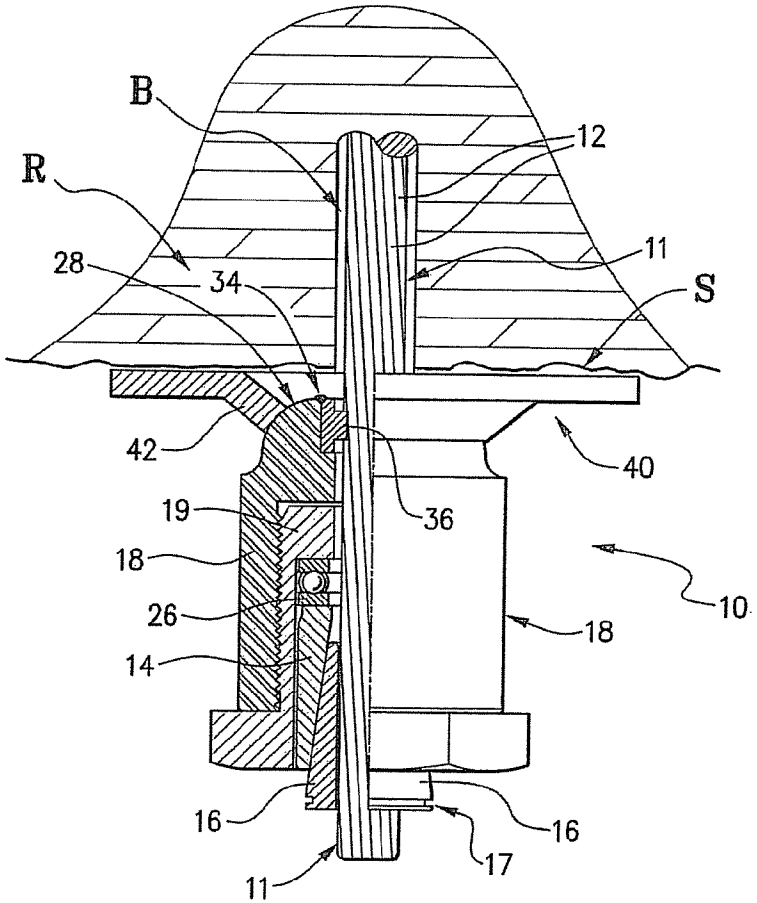
FIG. 3 shows a part-sectional side view of the cable bolt tensioning assembly of FIG. 2 in use with a cable bolt in a first non-tensioned configuration.

The assembly 10 may include two or more, in this case three, wedges 16*a*, 16*b* and 16*c* which are configured to be clamped about and against the cable bolt 11 as illustrated in FIGS. 3 and 4. The wedges 16*a*, 16*b* and 16*c* are placed upon the cable bolt 11 and held together at the bolt by an O-ring (or steel spring ring) that is located in an exposed groove 17, prior to the barrel 14 being located around the wedges.

The tensioning assembly 10 further comprises an outer member in the form of outer housing 18 and a carrier member in the form of inner housing 19. Outer housing 18 is provided with an internal thread 20 for complementary threaded engagement with an outer thread 21 located on a shank 22 of the inner housing 19 (the threads being most clearly depicted in FIG. 4). As also illustrated by FIGS. 3 and 4, the inner housing 19 is arranged to be unscrewed from the outer housing 18 in the direction of a longitudinal axis of the cable bolt to thereby tension the cable bolt (as described hereafter).

The inner housing 19 further comprises a hexagonal drive head 23 at the end of the shank 22 that is configured to be driven by an appropriate drill rig (e.g. via a dolly spanner). The drive head may alternatively comprises slots, similar to a standard or Phillip's head screw, to receive a complementary drive mechanism.

Figure 1B:
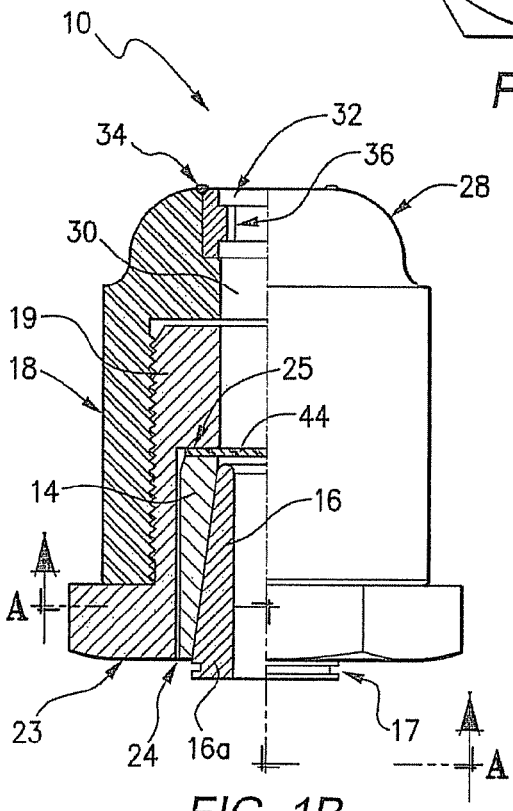
Figure 2:
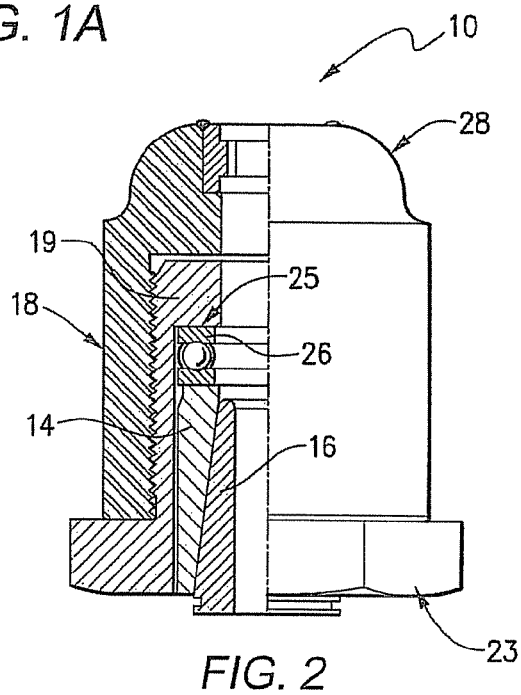
FIG. 2 shows a part-sectional side view of a cable bolt tensioning assembly in accordance with a second embodiment.
Figure 1C:
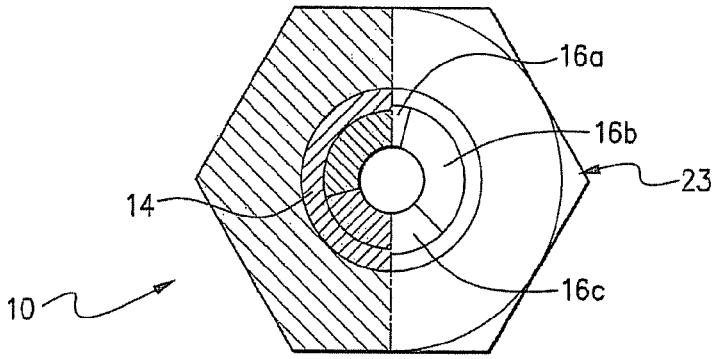

A recess 24 is defined to extend into the inner housing 19 from head 23 and part way into the shank 22, thereby defining a shoulder 25 within the recess. In the tensioning assembly embodiment of FIG. 1A it will be seen that the barrel 14 is received in recess 24 to oppose shoulder 25. In the tensioning assembly embodiment of FIG. 1 an anti-friction washer 44 is desposed between the barrel 14 and the shoulder 25, whereas in FIG. 2 it will be seen that a thrust bearing 26 is located between the barrel 14 and the shoulder 25. In either case, the recess and barrel are sized such that the inner housing 19 can rotate with respect to the barrel 14. The washer 44 or thrust bearing 26 aid such rotation as the cable bolt is progressively placed under increasing tension by the tensioning assembly. Also, as described hereafter, when the inner housing 19 is unscrewed from the outer housing 18 in the direction of a longitudinal axis of the cable bolt the shoulder 25 acts on the barrel 14 which in turn acts on the three wedges 16*a*, 16*b* and 16*c*, causing them to clamp about and against the cable bolt.

A rounded, tapering "bull-nosed" (alternatively frusto-conical) end 28 of the outer housing 18 has a passage-30 therethrough for the cable bolt. A hollow insert 32 is positionable for fastening in a recess defined in the end 28 to surround the passage 30 (with fastening occurring e.g. via a weld 34). The insert 32 comprises a number of elongate inwardly projecting protrusions in the form of ridges 36 that are adapted to extend interferingly into grooves defined between adjacent strands 12 of the cable bolt 11 (FIGS. 3 and 4). In this regard the ridges 36 can "bite" into the cable bolt external surface. This arrangement locks the cable bolt against twisting/rotation with respect to the outer housing 18.

The insert can be readily/easily fastened onto the cable bolt at a suitable location prior to locating the outer housing thereon (e.g. by sliding it along and then crimping it into place on the cable bolt). Alternatively, the insert and outer housing together can be fastened onto the cable bolt at a suitable location by being forcibly slid along the cable bolt and into place. In the form shown in FIGS. 1 and 2, the insert 32 is formed separately to the outer housing. In an alternative form, the outer housing may be machined to include the inwardly directed protrusions, extending into the passage thereby obviating the need for the separate insert 32.

As illustrated in FIGS. 3 and 4, the tensioning assembly 10 can further comprise a bearing plate 40 for slidable location on the cable bolt 11. In use, the plate 40 can be retained between the rounded end 28 of the outer housing 18 and a substrate in the form of a mine shaft roof R. The plate 40 is configured to abut the surface S surrounding a bore B in the roof R within which a portion of the cable bolt 11 has been inserted and anchored. In this regard, the plate 40 is provided with a central boss 42 for receiving there-against the rounded end 28 of the outer housing 18 when the assembly is used to tension the cable bolt. In use, the cable bolt extends through an aperture defined by the central boss, so that the plate is slid along the anchored cable and into position against the surface S. In a variation, the plate can be formed integrally with the outer housing, or the outer housing end 28 may even be shaped to simulate a plate-like bearer.

As described hereafter, during tensioning of the cable bolt, the interaction of the rounded end 28 with the central boss 42 is such as to prevent the outer housing 18 from rotating about its longitudinal axis. This, together with the locking at insert 32 of the cable bolt against twisting/rotation with respect to the outer housing 18, effectively restrains or prevents the cable bolt from twisting/rotation with respect to the bore B in the mine shaft roof R during cable bolt tensioning. The interaction of the rounded end 28 with the central boss 42 is such as to also promote an axial alignment of the plate 40 and outer housing 18, thereby avoiding lateral shear stresses between the bolt 11 and the assembly 10.

The configuration of the tensioning assembly 10 is such as to allow the assembly 10 to be located on the cable bolt 11, either prior to or after anchoring the cable bolt 11 in the bore B.

If the assembly 10 is to be preassembled on the cable bolt, the components may be positioned on the cable bolt and the barrel 14 and wedges 16*a*, 16*b*, and 16*c* are pretensioned so as to be caused to clamp onto the cable bolt. The outer and inner housing can then overlay the pretensioned barrel and wedge and may be held in place for transport by a plastic film or a settable polymeric or mastic wrap or through use of mechanical fasteners such as ties or grub screws or the like or by a combination of the foregoing.

Alternatively, the assembly 10 can be slid onto the end of the cable bolt after the bolt has been installed. Once in position the barrel 14 and wedges 16*a*-16*c* may then be caused to clamp the cable by inducing relative movement between the barrel and wedges.

Once the cable bolt 11 is point anchored in the bore B of mine shaft roof R and the tension assembly 10 is in place on the cable bolt 11, the assembly is ready for tensioning, as illustrated in FIG. 3.

A drilling rig is moved into proximity of the assembly 10, and a dolly spanner loaded into the chuck of that rig is coupled to the hexagonal drive head 23. The rig drive is activated and a torque of typically 100400 Nm is applied to the hexagonal drive head 23 to cause the inner housing 19 to start to rotate within and unscrew from the outer housing 18.

The initial rotation (unscrewing) of the inner housing 19 causes it to move away from the outer housing 18 in the direction of the cable bolt axis (i.e. downwardly in FIG. 3), whereby the shoulder 25 drives the barrel 14 (optionally via the washer 44 or thrust bearing 26) against the wedges 16*a*-*c*. The wedges are thus caused to further clamp against the cable bolt 11 and fasten the assembly to the bolt.

Throughout rotation of inner housing 19, the inner housing rotates on and around the barrel 14. In the assembly embodiment of FIG. 1, the shoulder 25 directly abuts the washer 44 and thus there is a continuing frictional resistance that must be overcome by the rig drive. In the assembly embodiment of FIG. 2, the thrust bearing 26 is located between the shoulder 25 and the barrel 14, whereby such frictional resistance is substantially reduced.

With the wedges now clamped against the bolt, continued rotation (unscrewing) of the inner housing 19 now forces the outer housing 18 against the plate 40 (i.e. upwardly in FIG. 4). Because the plate abuts the roof surface S it can only move up to a very limited extent (if at all) and so the downwardly moving inner housing 19 induces a tensile force in the cable bolt 11. Continued rotation (unscrewing) of the inner housing progressively increases this tensile force. This in turn provides a compressive force on the rock substrate S of the mine shaft roof R about the bore B.

In addition, with continued rotation of inner housing 19, the rounded end 28 of the outer housing 18 is driven into the boss 42 with a high degree of frictional engagement, thus preventing the outer housing 18 from rotating. Further, because the rounded end 28 is fastened to the cable bolt via the insert 32 to prevent the bolt from twisting with respect to the outer housing, the cable bolt is thus prevented from twisting with respect to the rock substrate S at the bore B. This means that the tensile force that is induced in the cable bolt 11 will be retained therein over time (i.e. the bolt does not untwist over time to release the tension therein).

Once a desired cable bolt tensile force is reached (usually determined by the rig drive motor, which will eventually stall), the drilling rig is then removed from the hexagonal drive head 23, leaving the cable bolt 11 and tensioning assembly 10 in place on the mine shaft roof R. As will be understood, the same process can be performed in various locations on the mine shaft roof using a plurality of cable bolts 11 with respective tensioning assemblies 10 attached thereto.

As clearly shown in FIGS. 3 and 4, the tensioning assembly 10 is located on the cable bolt 11 outside the bore B and, after tensioning, remains located outside the bore B. This means that the bore B can be sized just to accommodate the cable bolt 11, and need not be enlarged over all or part of its length to accommodate any part of the assembly. Thus, the bore can be formed in one drill pass, and also strong cable bolt anchoring with less resin can be achieved.

It should be noted that the thread between the inner and outer housings can be made left- or right-handed to suit a preferred direction of inner housing rotation (e.g. depending on the drive, application, user requirements etc).

In the above described embodiments, the outer housing 18 is prevented from rotating by frictional contact with the boss 42 of the bearing plate 40 (which, in turn is prevented from motion by being forced against the substrate surface S). FIGS. 5 through 14 illustrate further embodiments of the invention showing various different 10 ways in which the outer housing 18 and bearing plate 40 may interact to facilitate prevention of rotation of the outer housing 18.

Figure 5A:
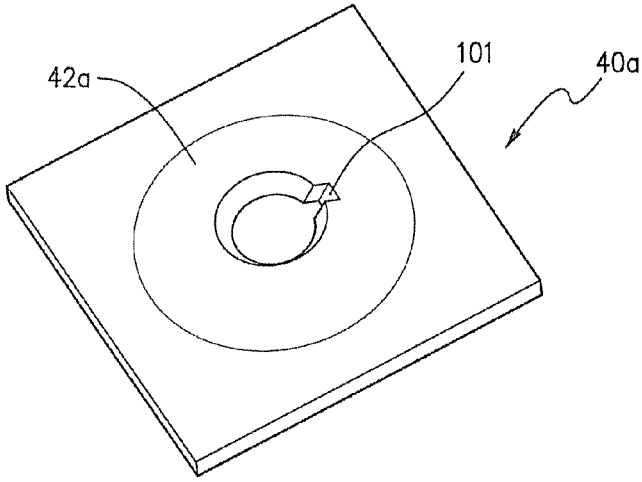
FIGS. 5A to C show a perspective view from below, a view from below and a side view of a bearing plate of a cable bolt tensioning assembly in accordance with an embodiment of the present invention.
Figure 6A:
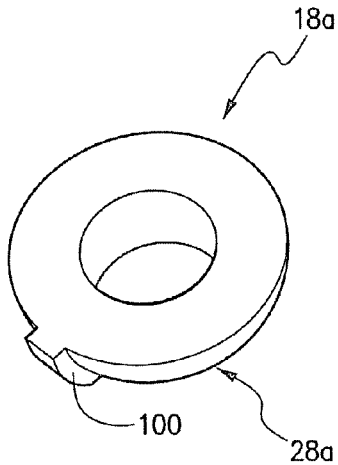
FIGS. 6A, B and C show a perspective view from below, a view from below and a sectional view of an outer housing of a cable bolt tensioning assembly in accordance with an embodiment of the present invention.
Figure 5B:
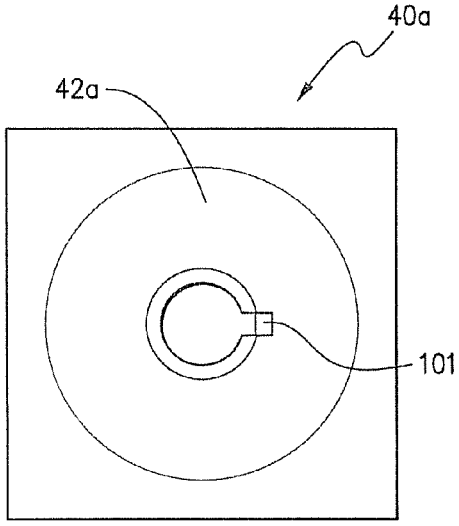
Figure 6B:
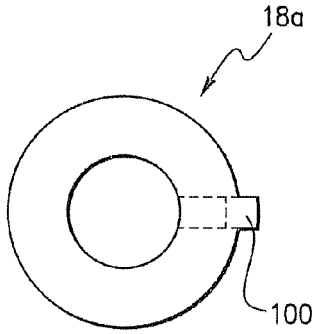
Figure 5C:
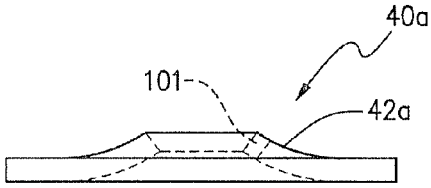
Figure 6C:
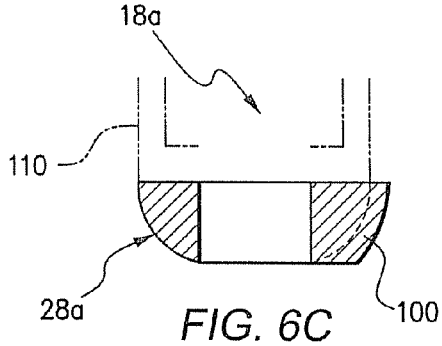
Figure 7A:
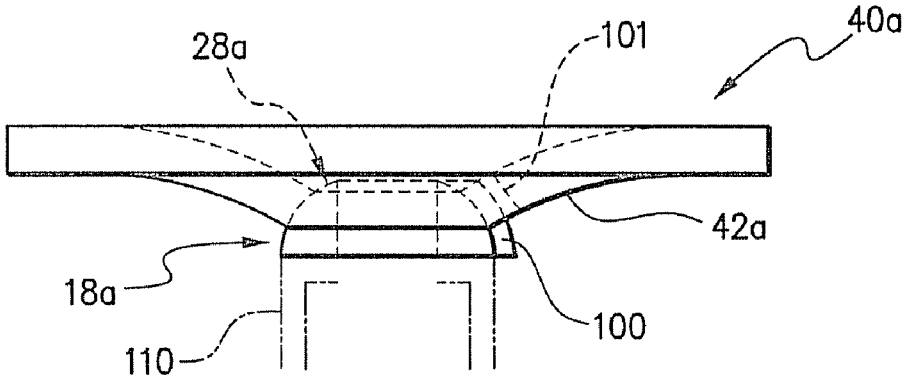
FIGS. 7A and B illustrate operation of the outer housing of FIG. 6 with the bearing plate of FIG. 5.
Figure 7B:
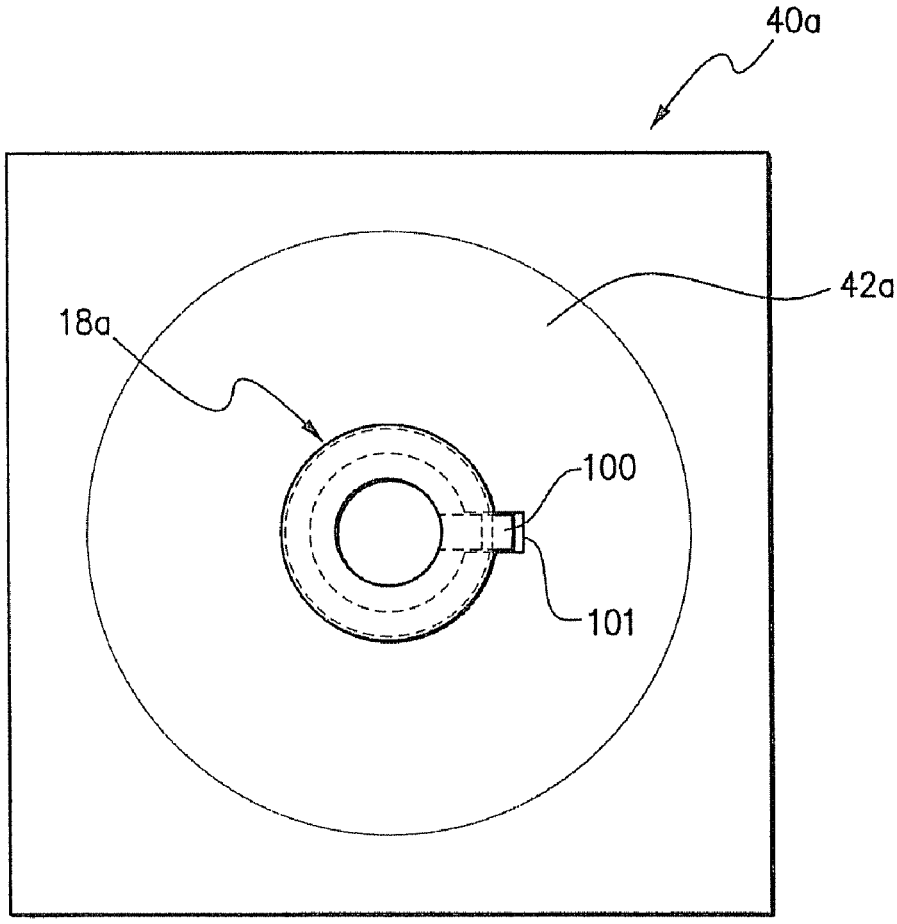

FIGS. 5 through 7 illustrate an embodiment where the outer housing 18*a* is provided with a key projection 100 which is arranged to interact with a corresponding slot 101 in the boss 42*a* of bearing plate 40*a*.

In operation the key projection 100 fits within the slot 101 and relative rotation between the bearing plate 40*a* and outer housing 18*a* is prevented.

In the illustrated embodiment, the key projection 100 extends from the top of the "bull-nose" end 28 to the main body of the housing 18*a*. This allows for the key projection 100 to still engage with the slot 101 when the housing 18*a* is tilted at an angle 20. with respect to the central boss 42*a* of the bearing plate 48, allowing for the axis of the cable bolt to be tilted with respect to the bearing plate 40*a*, which may occur in use.

FIGS. 7A and B illustrate how the outer housing 18*a* interacts with the bearing plate 40*a* in operation, with the key 100 fitting into the slot 101.

Note, that in the drawings, only the dome end 28*a* of the outer housing 18*a* is shown. In FIG. 6C the presence of the rest of the outer housing is indicated by ghost lines 110.

Figure 8A:
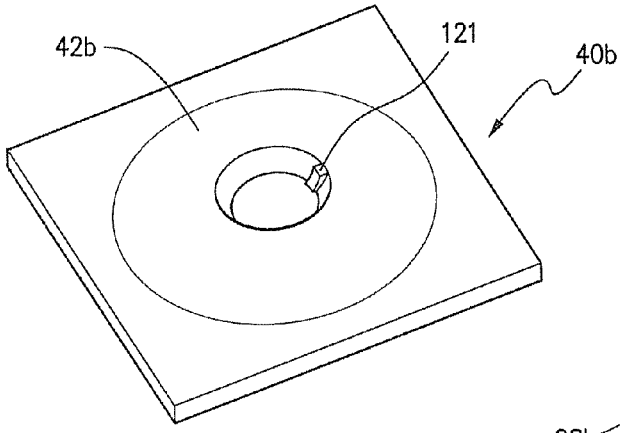
FIGS. 8A, B and C show a perspective view from below, a view from below and a side view of a bearing plate for a cable bolt tensioning assembly in accordance with a further embodiment of the invention.
Figure 9A:
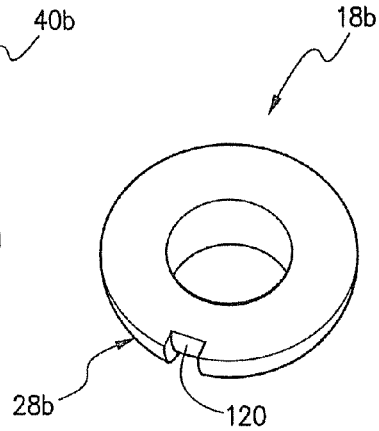
FIGS. 9A, B and C show a perspective view from below, a view from below, and a sectional view of an outer housing for a cable bolt tensioning assembly in accordance with a further embodiment of the invention.
Figure 8B:
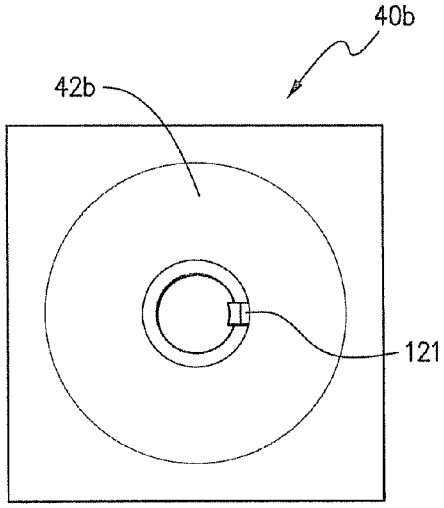
Figure 9B:
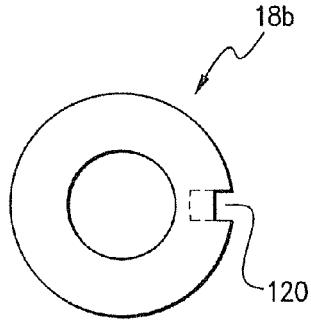
Figure 8C:
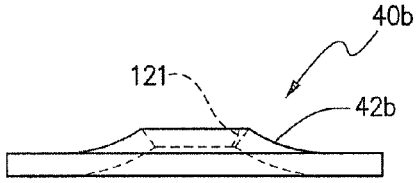
Figure 9C:
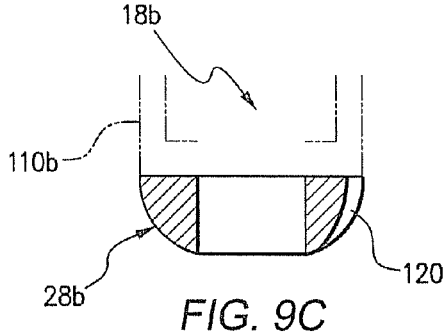
Figure 10A:
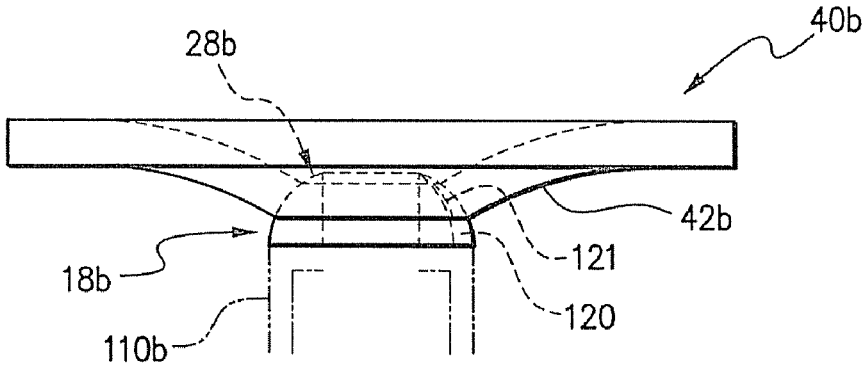
FIGS. 10A and B illustrate operation of the outer housing of FIG. 9 with the bearing plate of FIG. 8.
Figure 10B:
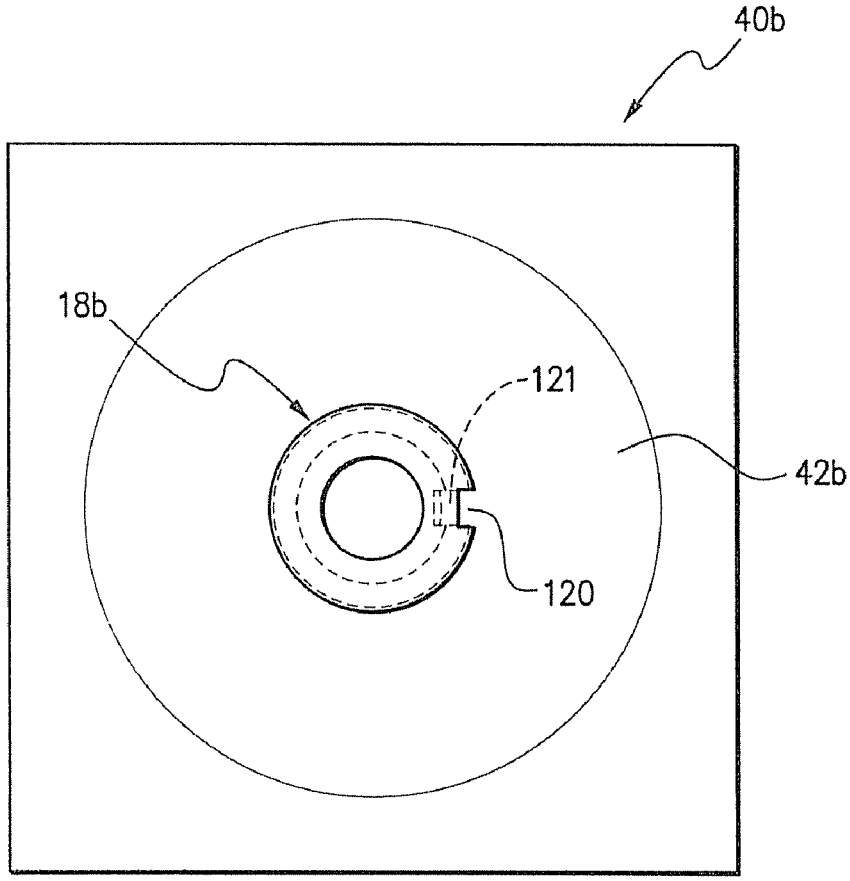

FIGS. 8 through 10 show an alternative embodiment, in which a slot 120 is provided in the domed end 28*b* of the outer housing 18*b* and a complimentary key projection 121 is mounted in the boss 42*b* of the bearing plate 40*b*. Operation of the embodiment of FIGS. 8 through 10 is similar to the operation of the embodiment of FIGS. 5 through 7, except the key 121 is provided in the bearing plate 40*b* and the slot 120 is provided in the outer housing 18*b*.

Figure 12A:
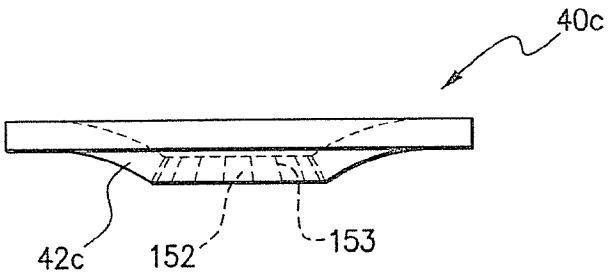
FIGS. 12A and B show a view from the side and a view from below of a bearing plate for use with the outer housing of FIGS. 11A and B.
Figure 12B:
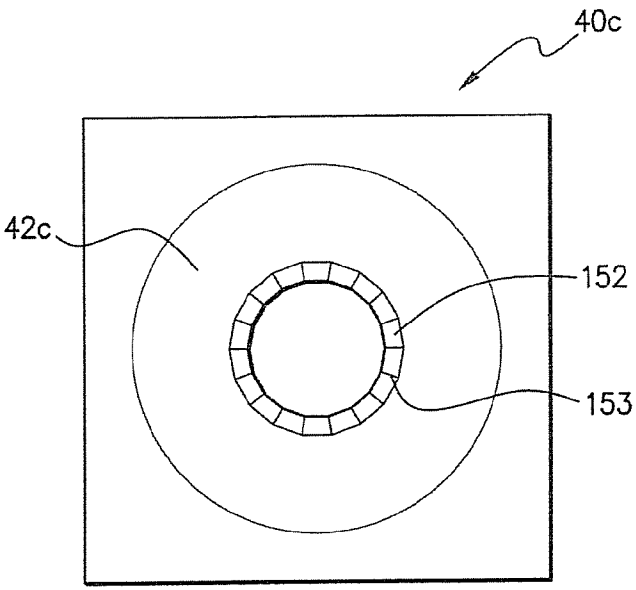
Figure 11A:
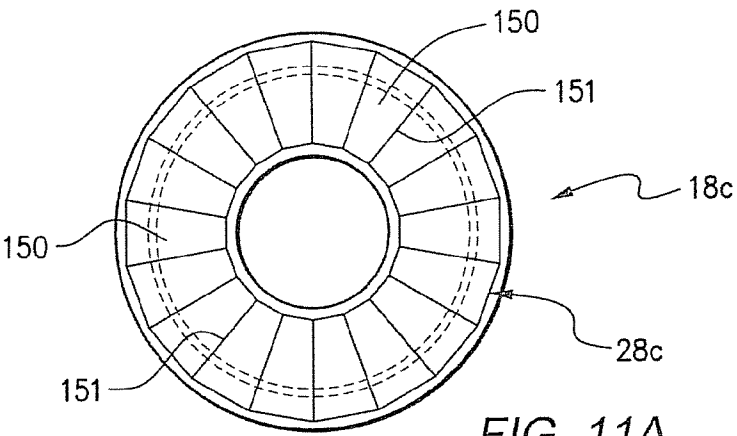
FIGS. 11A and B show a view from above and a side view of an outer housing for a cable bolt tensioning assembly in accordance with yet a further embodiment of the invention.
Figure 11B:
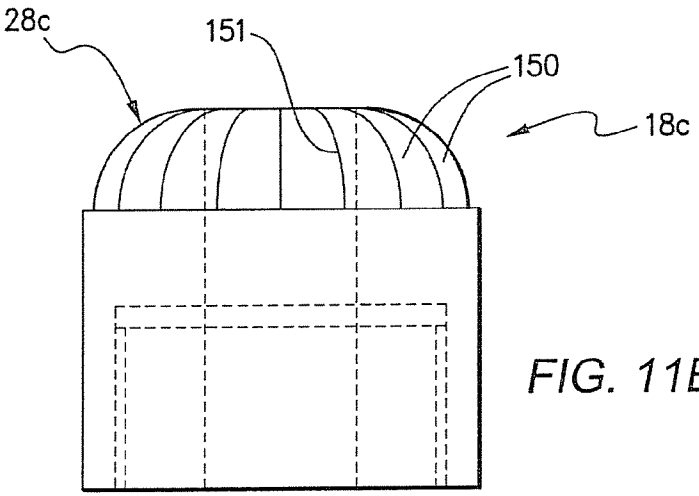

FIGS. 11 and 12 illustrate yet a further way in which the outer housing may engage with the bearing plate. In this embodiment, the domed end 28*c* of the outer housing 18*c* is provided with a plurality of key surfaces 150. The key surfaces 150 have edges 151 that define boundaries between each key surface 150. Complimentary receiving key surfaces 152 with edges 153 are provided in the receiving boss 42*c* of the bearing plate 40*c*.

In operation the key surfaces 150 of the outer housing 18*c* engage with complimentary key surfaces 152 of the boss 42*c*, preventing relative rotation between the outer housing 18*c* and the bearing plate 40*c*.

Figure 14A:
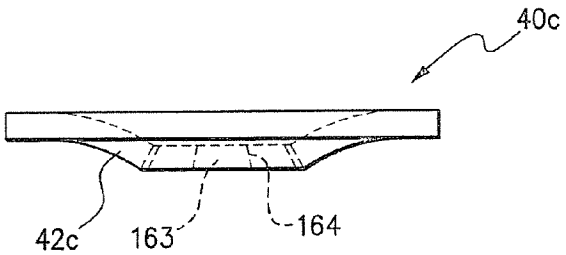
FIGS. 14A and B show a side view and a view from below of a bearing plate for use with the outer housing of FIGS. 13A and B.
Figure 14B:
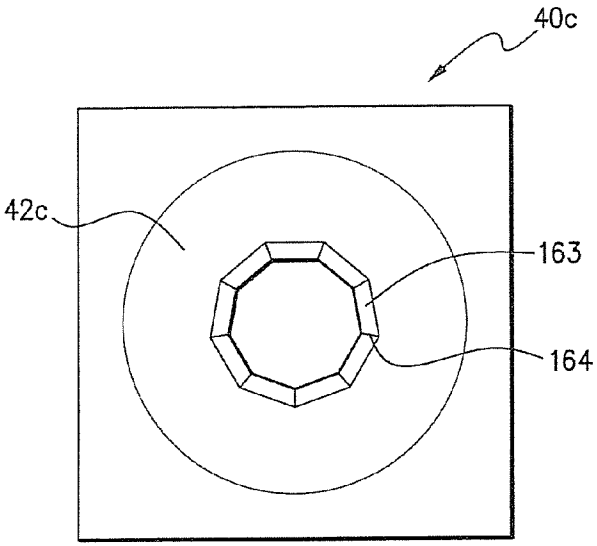
Figure 13A:
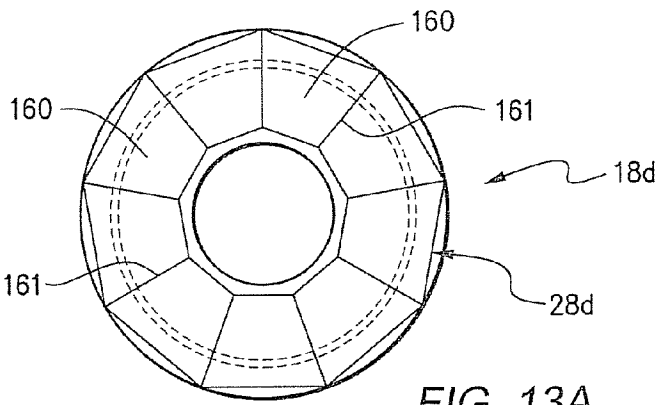
FIGS. 13A and B show a view from above and a side view of an outer housing for a cable bolt tensioning assembly in accordance with yet a further embodiment of the invention.
Figure 13B:
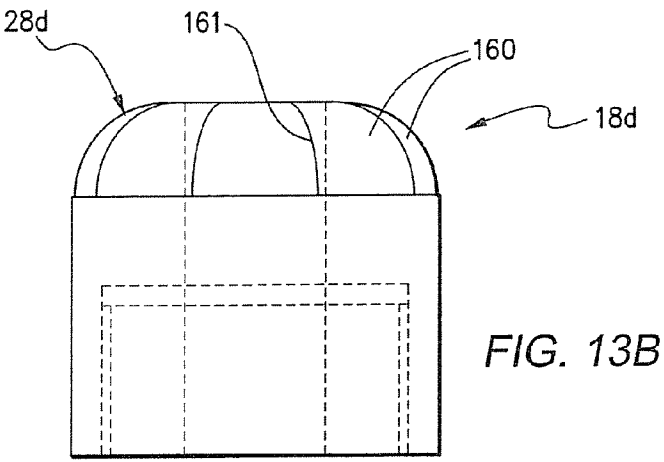

FIGS. 13 and 14 show yet a further embodiment which utilises key surfaces 160 and edges 161 on the outer housing 18*d*. These key surfaces 160 are similar in operation to the key surfaces of FIG. 11, but there are less of them. Complimentary key surfaces are provided on the boss 42*c* of the bearing plate 40*c*. They comprise complimentary surfaces 163 and edges 164.

As well as the above embodiments, there may be other arrangements which facilitate engagement of the domed end 28 of the outer housing with the bearing plate so that the outer housing does not rotate, and the cable is not twisted. For example, the embodiments of FIGS. 5 through 10 show only one key in slot arrangement. There may be two key in slot arrangements on opposite sides of the domed surface/bearing plate boss, or more than two.

Arrangements causing interference between the domed end 28 and bearing plate 40 could even be used in cable bolt tensioning assemblies that vary from the embodiments described with reference to FIGS. 1 to 4. In fact, any cable bolt tensioning assembly which requires interaction between a domed end of a tensioning component and a bearing plate may utilise any of these arrangements.

While the tensioning assembly and method for cable bolt tensioning has been described with reference to specific embodiments, it is to be understood that variations may be made to the without departing from the scope as defined herein.

In addition, it should be understood that the tensioning assembly and method are not limited to mining applications. Also, whilst the tensioning assembly and method have been described with reference to a roof, it will be understood that they can equally be applied to a sidewall or base/floor.

In the claims which follow and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the tensioning assembly and method.

The invention claimed is:

1. A tensioning assembly for a cable bolt, the assembly comprising:

a clamping device adapted for fastening to the bolt; and an outer member adapted for interacting with the clamping device whereby, during relative movement of the clamping device away from the outer member in the direction of the bolt's axis, the clamping device is caused to fasten to the bolt, with the outer member being further adapted for interacting with the bolt whereby, during such relative movement, twisting of the bolt with respect to the outer member is restrained, wherein the outer member comprises an internal surface portion that is adapted for engaging the strands of the bolt to restrain bolt twisting.

2. An assembly as claimed in claim 1, wherein the internal surface portion comprises one or more inwardly projecting elongate protrusions that are each positioned and shaped to protrude into a respective groove defined between adjacent bolt strands.

3. An assembly as claimed in claim 1, wherein the outer member has a barrel-like configuration that is substantially closed at one end save for a passage at that end for the cable bolt, and the internal surface portion is defined at the interior of a hollow insert that is positionable for fastening in a recess defined in the one end to surround the passage.

4. An assembly as claimed in claim 1, wherein the outer member is further adapted for interacting with rock strata into which the cable bolt is to be anchored in use whereby, as a result of such interaction, rotation of the outer member is restrained.

5. An assembly as claimed in claim 4, further comprising a plate-like member for facing and urging against the rock strata in use, the plate-like member being arranged with respect to the cable bolt such that, during the relative movement, an end of the outer member is caused to be brought into abutment with the plate-like member to provide sufficient frictional resistance to restrain outer member rotation.

6. An assembly as claimed in claim 5, wherein the end of the outer member is formed with a plurality of key surfaces and the plate-like member is formed with a plurality of complementary key surfaces, the key surfaces and complementary key surfaces being arranged to engage each other in operation to facilitate resistance to restrain outer member rotation.

7. A tensioning assembly for a cable bolt, the assembly comprising:

a clamping device adapted for fastening to the bolt;

an outer member adapted for interacting with the clamping device whereby, during relative movement of the clamping device away from the outer member in the direction of the bolt's axis, the clamping device is caused to fasten to the bolt, with the outer member being further adapted for interacting with the bolt whereby, during such relative movement, twisting of the bolt with respect to the outer member is restrained, wherein the outer member is further adapted for interacting with rock strata into which the cable bolt is to be anchored in use whereby, as a result of such interaction, rotation of the outer member is restrained; and a plate-like member for facing and urging against the rock strata in use, the plate-like member being arranged with respect to the cable bolt such that, during the relative movement, an end of the outer member is caused to be brought into abutment with the plate-like member to provide sufficient frictional resistance to restrain outer member rotation, wherein the end of the outer member and the plate-like member are provided with a complementary key projection and slot arranged to interfere with each other in operation to facilitate resistance to restrain outer member motion.

8. An assembly as claimed in claim 7, wherein the slot is provided in the end of the outer member and the key projection is provided mounted on the plate-like member.

9. An assembly as claimed in claim 7, wherein the key projection is mounted on the end of the outer member and the slot is provided in the plate-like member.

10. A tensioning assembly for a cable bolt, the assembly comprising:

a clamping device adapted for fastening to the bolt;

an outer member adapted for interacting with the clamping device whereby, during relative movement of the clamping device away from the outer member in the direction of the bolt's axis, the clamping device is caused to fasten to the bolt, with the outer member being further adapted for interacting with the bolt whereby, during such relative movement, twisting of the bolt with respect to the outer member is restrained; and a carrier member for the clamping device that includes a hollow shank for receipt of the cable bolt therethrough, with the shank being externally threaded for engagement with a corresponding internal thread defined at an interior surface of the outer member.

11. An assembly as claimed in claim 10, wherein the relative movement arises from the carrier member being unscrewed from the outer member.

12. An assembly as claimed in claim 10, wherein the clamping device comprises a barrel and wedge assembly, the barrel being locatable for rotation in a recess of the carrier member that extends into the hollow of the shank, and the barrel surrounding the wedges in the recess whereby, during the relative movement, the barrel is urged against the wedges to force them against the cable bolt, thereby fastening the clamping device to the bolt.

13. An assembly as claimed in claim 12, wherein a tapered inner surface of the barrel is urged against a corresponding and oppositely tapered outer surface of each wedge by the action of a shoulder defined at an interior end of the carrier member recess.

14. An assembly as claimed in claim 13, further comprising a thrust bearing or anti-friction washer that is located between the barrel and the shoulder.

15. An assembly as claimed in claim 10, wherein movement of the carrier member away from the outer member is facilitated by a carrier member head defined at an end of the carrier member shank that extends beyond the outer member, the head being shaped for engagement by a drive apparatus.

16. A tensioning assembly for a cable bolt, the assembly comprising:

a clamping device adapted for fastening to the bolt;

a carrier member for the clamping device; and an outer member adapted for location on the carrier member whereby an end of the carrier member projects beyond the outer member, with the end being adapted for engagement by a drive apparatus to cause a relative movement of the carrier member away from the outer member in the direction of the bolt's axis, which movement causes the clamping device to fasten to the bolt, wherein the outer member is further adapted for interacting with the bolt whereby, during the relative movement, twisting of the bolt is restrained.

17. A method for tensioning a cable bolt at a rock substrate, the method comprising the steps of:

anchoring the cable bolt within a bore formed in the rock substrate;

positioning a tensioning assembly on the cable bolt;

tensioning the cable bolt using the tensioning assembly; and engaging strands of the cable bolt with the tensioning assembly to restrain twisting of the cable bolt.

18. A method as claimed in claim 17, wherein the step of positioning the tensioning assembly on the cable bolt occurs prior to the step of anchoring the cable bolt within the bore.

19. A method as claimed in claim 17, wherein the tensioning assembly is positioned on a portion of the cable bolt that extends beyond the bore.

20. A method as claimed in claim 19, wherein the anchoring step comprises inserting a fixative container into the bore, then inserting the cable bolt into the bore to cause the cable bolt to fracture the container and release a fixative substance from within the container into the space in the bore surrounding the cable bolt, and allowing the fixative substance to cure prior to tensioning the cable bolt.

* * * * *